US007207556B2

(12) United States Patent
Saitoh et al.

(10) Patent No.: US 7,207,556 B2
(45) Date of Patent: Apr. 24, 2007

(54) SHEET FINISHER HAVING AN ANGULARLY MOVABLE STAPLER AND IMAGE FORMING SYSTEM INCLUDING THE SAME

(75) Inventors: Hiromoto Saitoh, Kanagawa (JP); Kenji Yamada, Tokyo (JP); Masahiro Tamura, Kanagawa (JP); Nobuyoshi Suzuki, Tokyo (JP); Hiroki Okada, Kanagawa (JP); Shuuya Nagasako, Tokyo (JP); Akihito Andoh, Kanagawa (JP); Junichi Iida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 291 days.

(21) Appl. No.: 10/395,053

(22) Filed: Mar. 25, 2003

(65) Prior Publication Data

US 2003/0219295 A1 Nov. 27, 2003

(30) Foreign Application Priority Data

Mar. 25, 2002 (JP) ..... 2002-082400
Jan. 21, 2003 (JP) ..... 2003-012501

(51) Int. Cl.
*B27F 7/00* (2006.01)
*B65H 39/00* (2006.01)

(52) U.S. Cl. ..... 270/58.08; 270/58.09; 270/58.1; 270/58.11; 270/58.12; 270/58.13; 227/110; 227/111; 227/148; 227/410

(58) Field of Classification Search ..... 270/58.08, 270/58.09, 58.1, 58.11, 58.12, 58.13; 227/110, 227/111, 148, 410; 399/410
See application file for complete search history.

(56) References Cited

U.S. PATENT DOCUMENTS 5,255,902 A * 10/1993 Coombs ..... 270/58.14
5,290,020 A * 3/1994 Matsui et al. ..... 270/58.19
5,447,298 A * 9/1995 Watanabe et al. ..... 270/58.11
5,508,798 A 4/1996 Yamada
5,692,411 A 12/1997 Tamura
5,762,328 A 6/1998 Yamada et al.

(Continued)

FOREIGN PATENT DOCUMENTS

JP 05221582 A * 8/1993

(Continued)

OTHER PUBLICATIONS

U.S. Appl. No. 11/267,403, filed Nov. 7, 2005, Tokita et al.

(Continued)

*Primary Examiner*—Gene O. Crawford
*Assistant Examiner*—Leslie A. Nicholson, III
(74) *Attorney, Agent, or Firm*—Oblon, Spivak, McClelland, Maier & Neustadt, P.C.

(57) ABSTRACT

A sheet finisher for executing preselected processing with a sheet introduced thereinto from an image forming apparatus and then discharging the sheet is disclosed. The sheet finisher includes a stacking device configured to temporarily stack sheets sequentially delivered thereto. Jogger fences jog each sheet within the stacking device. A stapler staples the sheet stack jogged in the stacking device. The stapler is supported by a guide shaft such it is movable along the guide shaft in a direction perpendicular to the direction of sheet conveyance and angularly movable in a direction perpendicular to the direction of guide.

20 Claims, 16 Drawing Sheets

U.S. PATENT DOCUMENTS 6,145,825 A 11/2000 Kunihiro et al.
6,164,511 A * 12/2000 Chung et al. ..... 227/148
6,199,853 B1 3/2001 Andoh et al.
6,231,045 B1 5/2001 Yamada et al.
6,264,191 B1 7/2001 Suzuki et al.
6,296,247 B1 10/2001 Tamura et al.
6,322,070 B2 11/2001 Yamada et al.
6,341,772 B1 * 1/2002 Waragai et al. ..... 270/58.08
6,343,785 B1 * 2/2002 Yamada et al. ..... 270/58.08
6,394,448 B2 5/2002 Suzuki et al.
6,402,006 B1 * 6/2002 Nunes et al. ..... 227/110
6,416,052 B2 7/2002 Yamada et al.
6,494,449 B2 12/2002 Tamura et al.
6,494,453 B1 12/2002 Yamada et al.
6,527,269 B2 3/2003 Yamada et al.
6,549,734 B2 4/2003 Yamada et al.
6,746,008 B2 * 6/2004 Coombs et al. ..... 270/58.08
2003/0219295 A1 11/2003 Saitoh et al.

FOREIGN PATENT DOCUMENTS

JP 11263521 A * 9/1999
JP 2000-169028 6/2000
JP 2001-171898 6/2001

OTHER PUBLICATIONS

U.S. Appl. No. 11/273,301, filed Nov. 15, 2005, Iida et al.

* cited by examiner

SHEET FINISHER HAVING AN ANGULARLY MOVABLE STAPLER AND IMAGE FORMING SYSTEM INCLUDING THE SAME

BACKGROUND OF THE INVENTION

1. Field of the Invention

The present invention relates to a sheet finisher constructed integrally or separately from a copier, printer or similar image forming apparatus for executing sorting, stacking, jogging, stapling, center stapling and binding, punching or similar processing with sheets carrying images thereon and then discharging the sheets, and an image forming system made up of the sheet finisher and image forming apparatus.

2. Description of the Background Art

A sheet finisher configured to automatically execute processing of the kind described above with sheets sequentially driven out of an image forming apparatus has been proposed in various forms in the past. Particularly, various methods have been proposed for the movement of a stapler. Japanese Patent Laid-Open Publication No. 9-235070, for example, discloses a sheet finisher including a stapler mounted on a guide shaft, which extends between the front and rear side walls of a staple tray. The stapler is movable in a direction perpendicular to the direction of sheet conveyance and slidable in the direction of sheet conveyance as well.

More specifically, in the above conventional sheet finisher, after the trailing edge of a sheet stack has been positioned by being abutted against a reference fence located below the staple tray, a hook affixed to a timing belt or similar band-like drive transmitting means lifts the trailing edge of the sheet stack for thereby causing the sheet stack to be driven out to a tray. The stapler is allowed to slide in the direction of sheet conveyance such that it does not contact a pulley or similar rotary member, which drives the drive transmitting means, when moving in the direction perpendicular to the direction of sheet conveyance.

However, to allow the stapler to move in both of the direction of sheet conveyance and the direction perpendicular thereto, the conventional sheet finisher needs a number of parts and is therefore sophisticated in configuration. In addition, such a number of parts increase the cost of the sheet finisher.

Technologies relating to the present invention are also disclosed in, e.g., Japanese Patent Laid-Open Publication Nos. 2000-169028, 2001-171898 and 2002-273705.

SUMMARY OF THE INVENTION

It is an object of the present invention to provide a sheet finisher allowing a stapler to move in the direction perpendicular to the direction of sheet conveyance without contacting a pulley or similar rotary member with a simple configuration, and an image forming system including the same.

It is another object of the present invention to provide a sheet finisher capable of reducing drive loads necessary for a stapler to move in the direction perpendicular to the direction of sheet conveyance and angularly move about a guide shaft and desirable in durability, and an image forming system including the same.

A sheet finisher of the present invention, which executes preselected processing with a sheet introduced thereinto from an image forming apparatus and then discharges it, includes a stacking device configured to temporarily stack sheets sequentially delivered thereto. Jogger fences jog each sheet within the stacking device. A stapler staples the sheet stack jogged in the stacking device. The stapler is supported by a guide shaft such it is movable along the guide shaft in a direction perpendicular to the direction of sheet conveyance and angularly movable in a direction perpendicular to the direction of guide.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
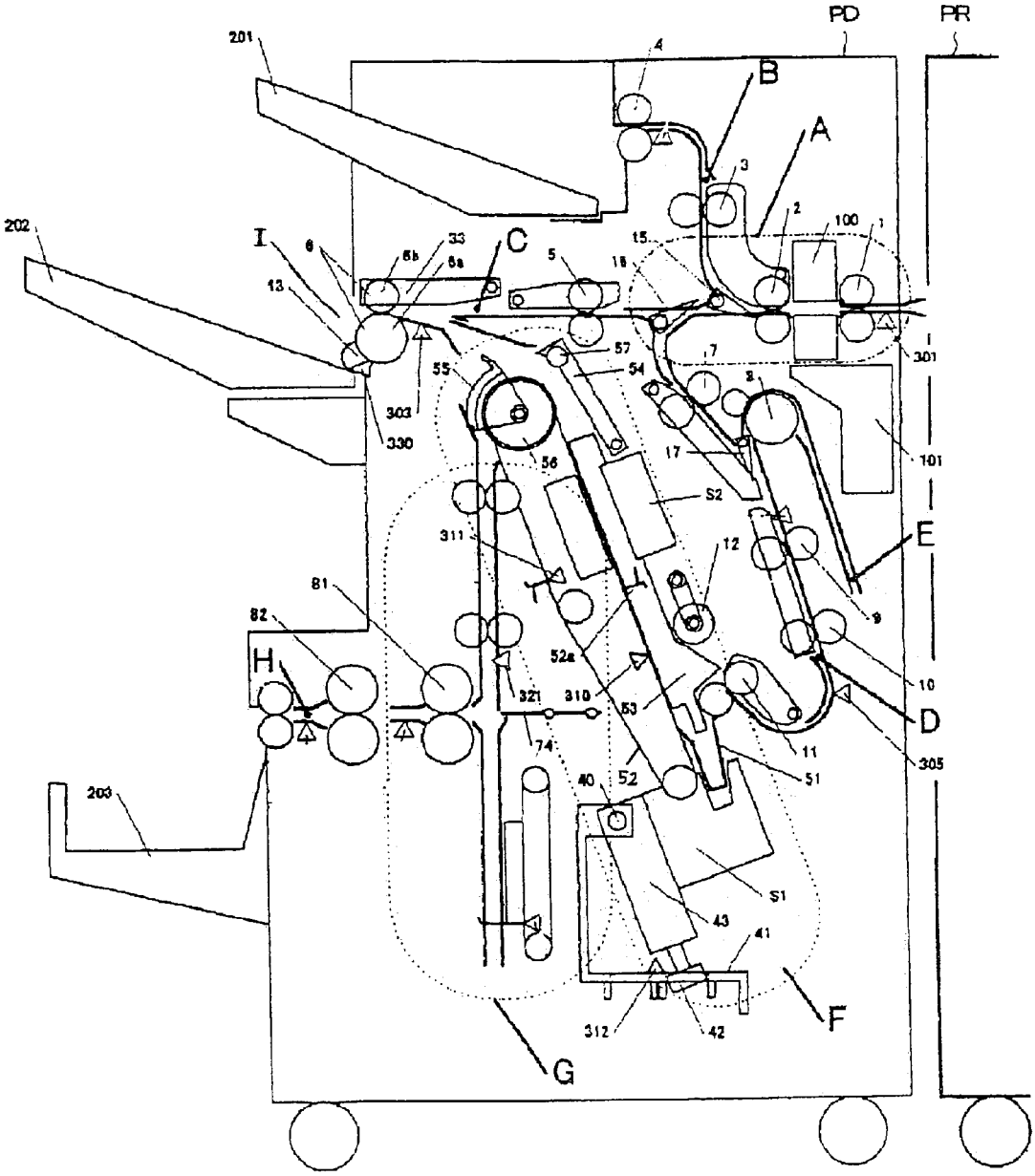
FIG. 1 is a view showing an image forming system embodying the present invention and made up of a sheet finisher and an image forming apparatus.

Referring to FIG. 1 of the drawings, an image forming system embodying the present invention is shown. As shown, the image forming system is generally made up of a sheet finisher PD and an image forming apparatus PR. The sheet finisher PD is connected to one side of the image forming apparatus RP, so that a sheet or recording medium driven out of the latter is introduced into the former. The sheet introduced into the sheet finisher PD is conveyed along a path A on which finishing means for finishing a single sheet is positioned. In the illustrative embodiment, the finishing means is implemented as a punch unit or punching means 100.

The path A merges into a path B terminating at an upper tray 201, a path C terminating at a shift tray 202, and a path D terminating at a staple tray or processing tray F, which performs positioning and stapling. Path selectors 15 and 16 each steer the sheet coming out of the path A to designated one of the paths B through D. A stack of sheets positioned and stapled on the staple tray F is guided to either one of the path C and a fold tray or processing tray G by a guide plate and a movable guide 55, which constitute steering means. The sheet stack stapled on the fold tray G is driven out to a lower tray 203 via a path H.

A path selector 17 is positioned on the path D and constantly biased by a light-load spring to a position shown in FIG. 1. An arrangement is made such that after the trailing edge of the sheet has moved away from the path selector 17, among rollers 9 and 10 and a stapler inlet roller 11, at least the roller 9 can be rotated in the reverse direction to introduce the trailing edge of the sheet into a prestacking section E. This allows a plurality of sheets sequentially stacked in the prestacking section E to be conveyed together.

An inlet sensor 301 responsive to the sheet, an inlet roller 1, the punch unit 100, a hopper 101 for storing sheet scraps, a roller 2 and the path selectors 15 and 16 re sequentially positioned on the path in the direction of sheet conveyance. Springs, not shown, bias the path selectors 15 and 16 to positions shown in FIG. 1. When solenoids assigned to the path selectors 15 and 16, respectively, are turned on, the path selectors 15 and 16 are angularly moved upward and downward, respectively, for thereby steering the sheet to designated one of the paths B through D.

More specifically, to steer the sheet to the path B, the path selector 15 is held in the position of FIG. 1 while the solenoids are turned off. To steer the sheet to the path C, the solenoids are turned on to move the path selectors 15 and 16 upward and downward, respectively. Further, to steer the sheet to the path D, the solenoid assigned to the path selector 16 is turned off while the solenoid assigned to the path selector 15 is turned on to move the path selector 15 upward. The reference numerals 3, 4, 5, 7 and 8 designate rollers for conveying the sheet.

The sheet finisher PD is capable of selectively punching a sheet with the punch unit 100, jogging and edge-stapling sheets with a pair of jogger fences 53 and an edge-stapler S1, jogging and center-stapling sheets with the jogger fences 53 and center staplers S2, sorting sheets with the shift tray 202 or folding sheets with a fold plate 74 and fold rollers 81 and 82, as desired.

In the illustrative embodiment, using an electrophotographic process, the image forming apparatus PR optically scans a photoconductive drum or similar image carrier in accordance with image data to thereby form a latent image, develops the latent image with toner, transfers the resulting toner image to a sheet, fixes the toner image on the sheet, and then drives the sheet or pint out of the apparatus. Such an image forming apparatus is conventional and will not be shown or described specifically. Of course, the electrophotographic image forming apparatus may be replaced with an ink jet printer or any other image forming apparatus known in the art.

Figure 2:
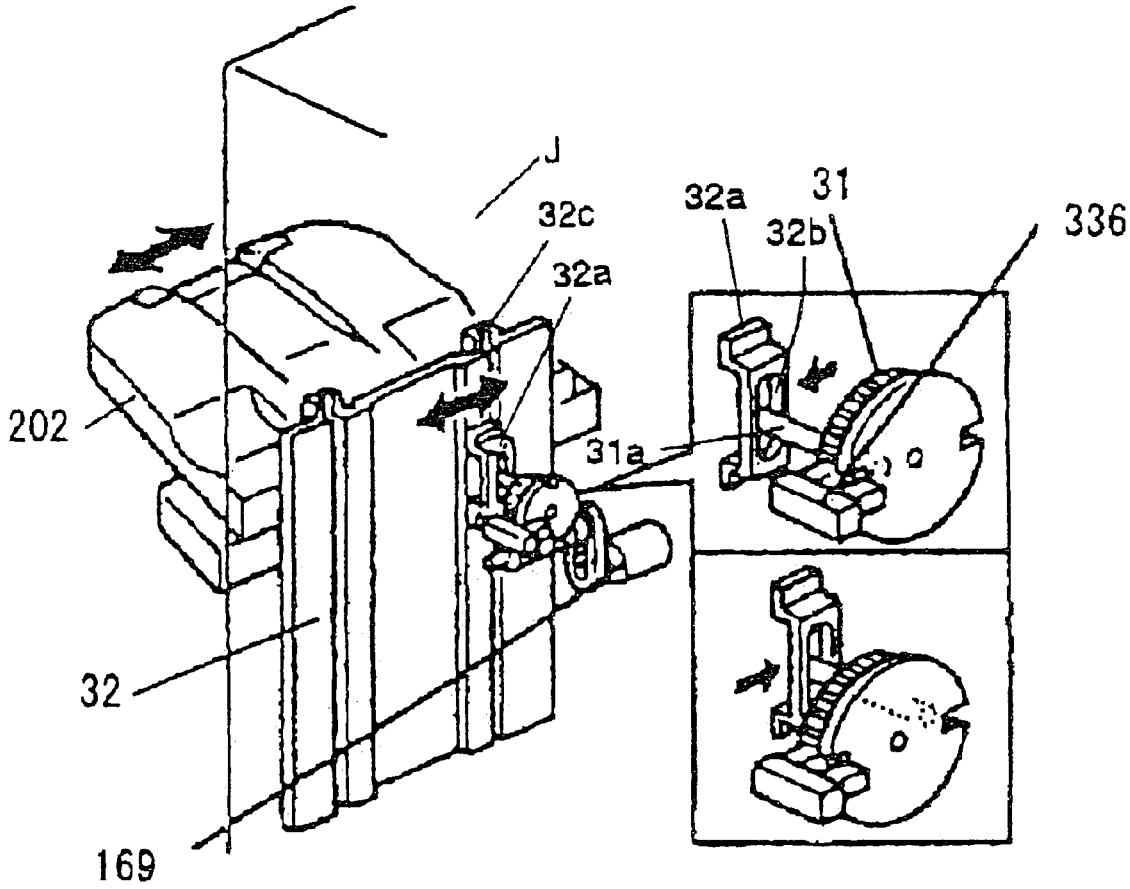
FIG. 2 is an isometric view showing a shifting mechanism included in the sheet finisher.
Figure 3:
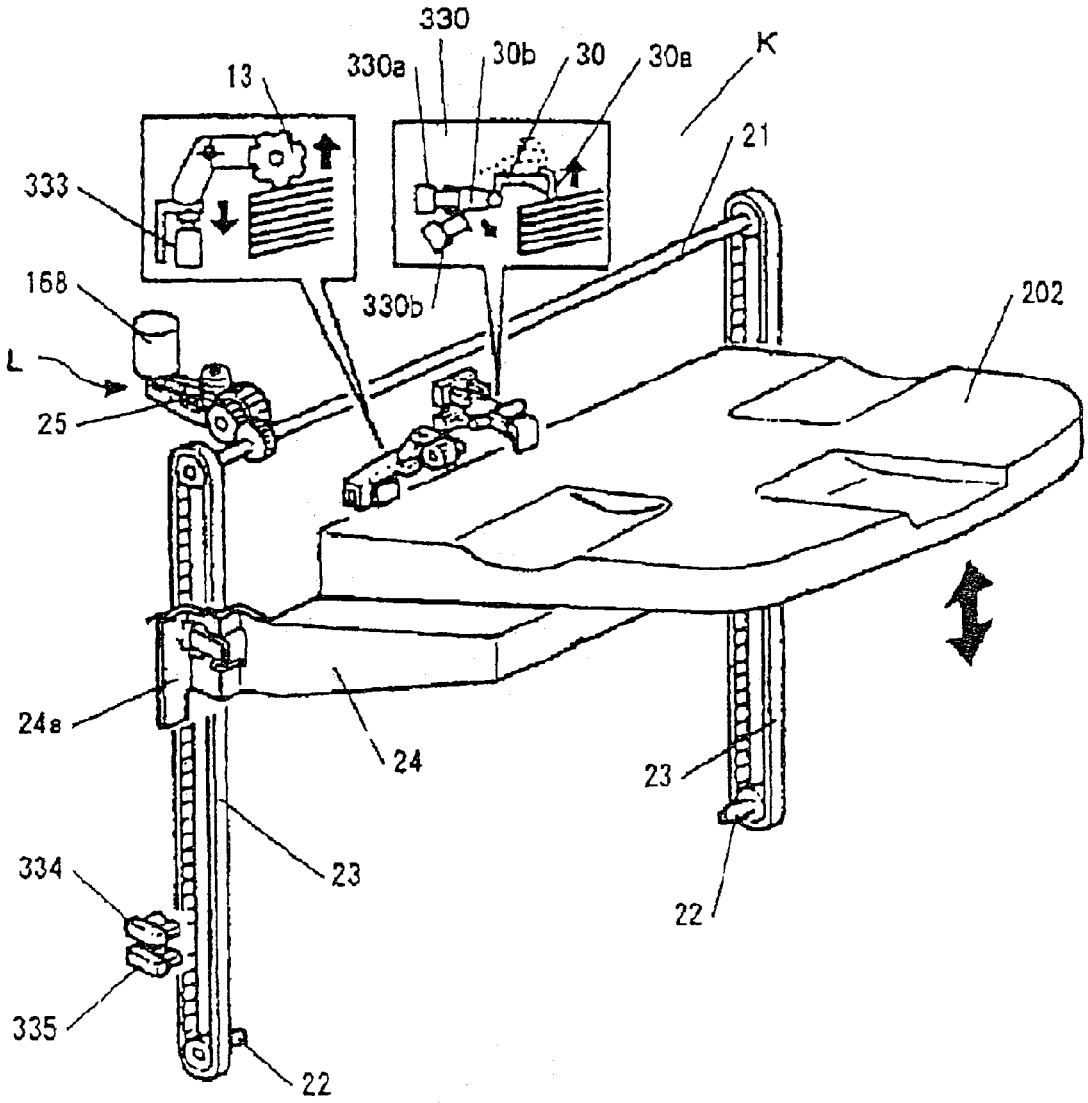
FIG. 3 is a fragmentary perspective view showing a shift tray elevating mechanism included in the sheet finisher.

A shift tray outlet section I, located at the most downstream side of the sheet finisher PD, includes an outlet roller pair 6, a return roller 13, a sheet surface sensor 330, the shift tray 202, a shifting mechanism J (see FIG. 2), and a shift tray elevating mechanism K (see FIG. 3). As shown in FIGS. 1 through 3, the return roller 13 presses the trailing edge of the sheet driven out by the outlet roller pair 6 against an end fence 32, FIG. 2, for thereby positioning the sheet. The return roller 13 is driven by the shift roller pair 6. A limit switch 333 adjoins the return roller 13 and turns on when the shift tray 202 is elevated to push the return roller 13 upward, thereby turning off a tray motor 168. This prevents the shift tray 202 from overrunning. As shown in FIG. 1, the sheet surface sensor or sheet surface position sensing means 330 also adjoins the return roller 13 and senses the surface position of a sheet or a sheet stack driven out to the shift tray 202.

As shown in FIG. 3, the sheet surface sensor 330 includes a lever 30 and sensors 330*a* and 330*b* assigned to a staple mode and a non-staple mode, respectively. The lever 30 is angularly movable about its shaft portion and includes a contact portion 30*a* contacting the top sheet stacked on the shift tray 202 and a sectorial interrupter portion 30*b*. The upper sensor 330*a* and lower sensor 330*b* are mainly used for staple discharge control and non-staple discharge control, respectively.

More specifically, the sensors 330*a* and 330*b* each turn on when the optical path thereof is interrupted by the interrupter portion 30*b* of the lever 30. When the shift tray 202 is elevated while causing the contact portion 30*a* of the lever 30 to move upward, the sensors 330*a* and 330*b* are sequentially turned off in this order. When the sheet stack on the shift tray 202 reaches a preselected height, as determined by the sensors 330*a* and 330*b*, the tray motor 168 is driven to lower the shift tray 202 by a preselected distance. Consequently, the sheet surface on the shift tray 202 is held at substantially the same height.

The shift tray elevating mechanism will be described with reference to FIG. 3. As shown, a drive unit L causes the shift tray 202 to move upward or downward via a drive shaft 21. Timing belts 23 are passed over the drive shaft 21 and a driven shaft 22 via timing pulleys under preselected tension. A support plate 24 supports the shift tray 202 and is affixed to the timing belts 23. In this configuration, the unit including the shift tray 202 is suspended from the timing belts 23 in such a manner as to be movable up and down.

The drive unit L includes a worm gear 25 in addition to the tray motor 168, which is a reversible motor or drive source. The output torque of the tray motor 168 is transferred to the last gear of a gear train affixed to the drive shaft 21 via the worm gear 25, moving the shift tray 202 upward or downward. The worm gear 25 present in the driveline allows the shift tray 202 to remain at a preselected position and obviates the fall or similar accident of the shift tray 202.

An interrupter 24*a* is formed integrally with the support plate 24 and turns on or turns off a full sensor 334 and a lower limit sensor 335, which are positioned below the interrupter 24*a*. The full sensor 334 and lower limit sensor 335 are responsive to the full condition and lower limit position of the shift tray 202, respectively. The full sensor 334 and lower limit sensor 335 are implemented as photosensors, and each turns on when the optical path thereof is interrupted by the interrupter 24*a*. The outlet roller pair 6 is not shown in FIG. 3.

As shown in FIG. 2, the shifting mechanism assigned to the shift tray 202 includes a shift motor or drive source 169 and a cam 31. The shift motor 169 causes the shift tray 202 to move in the direction perpendicular to the direction of sheet discharge via the cam 31. A pin 31*a* is studded on the cam 31 at a position remote from the axis of the cam 31 by a preselected distance. The fee end of the pin 31*a* is loosely fitted in an elongate slot 32*b* formed in an engaging member 32*a*, which is affixed to the rear surface of the end fence 32 where the shift tray 202 is absent. In this configuration, the engaging member 32*a* and therefore shift tray 202 moves in the direction perpendicular to the direction of sheet discharge in accordance with the movement of the pin 31*a* of the cam 31.

The shift tray 202 is caused to stop at the front and rear positions as seen in the direction perpendicular to the sheet surface of FIG. 1. To control the stop of the shift tray 202, the shift motor 169 is selectively turned on or turned off in accordance with the output of a shift sensor 336 responsive to a notch formed in the cam 31.

Ridges 32*c* are formed on the front surface of the end fence 32 while the rear end of the shift tray 202 is engaged with the ridges 32*c* to be movable up and down. The shift tray 202 is therefore supported by the end fence 32 in such a manner as to be movable up and down and in the direction perpendicular to the direction perpendicular to the direction of sheet discharge, as needed. The end fence 32 additionally serves to guide and position the rear edges of sheets stacked on the shift tray 202.

Figure 4:
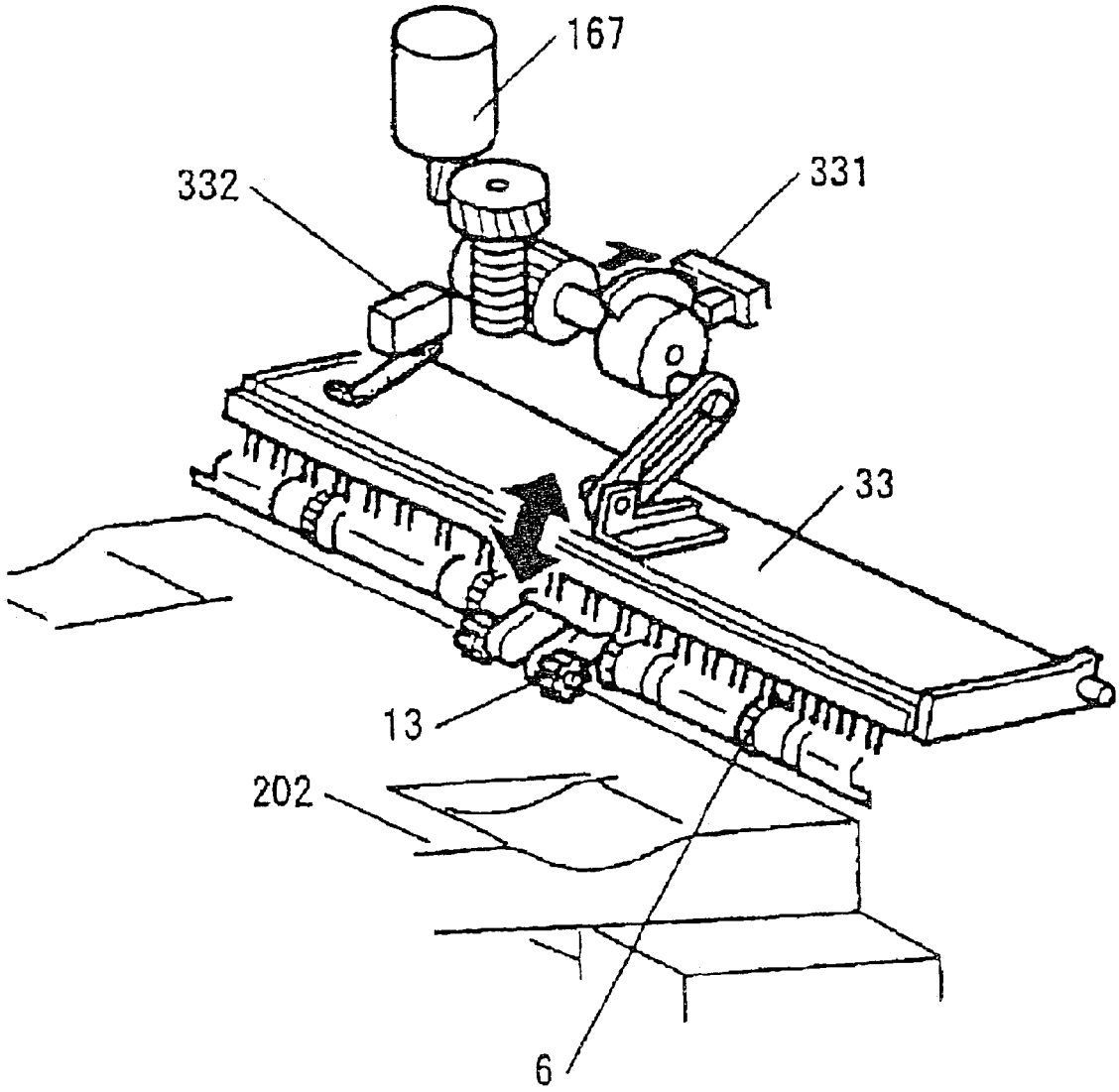
FIG. 4 is an isometric view showing a outlet section included in the sheet finisher for discharging sheets to a shift tray.

FIG. 4 shows the section for discharging the sheet to the shift tray 202 more specifically. As shown in FIGS. 1 and 4, the outlet roller pair 6 is made up of a drive roller 6*a* and a driven roller 6*b*. The driven roller 6*b* is rotatably supported by the free end of a guide plate 33, which is angularly movable up and down about its upstream end in the direction of sheet discharge. The driven roller 6*b* is held in contact with the drive roller 6*a* due to its own weight or by a biasing force, so that a sheet or sheet stack is driven out to the shift tray 202 by the two rollers 6*a* and 6*b*. When a stapled sheet stack is to be driven out, the guide plate 33 is moved upward and then lowered at preselected timing in accordance with the output of a discharge sensor 303. The guide plate 33 is brought to a stop at a position determined by the output of a guide plate open/close sensor 331 and is driven by a guide plate motor 167, which is, in turn, driven in accordance with the ON/OFF of a guide plate limit switch 332.

The staple tray F will be described with reference to FIGS. 5 through 7 in detail. As shown in FIG. 6, sheets are sequentially conveyed to and stacked on the staple tray F by the stapler inlet roller 11. Every time a sheet is laid on the staple tray F, a knock roller 12 knocks the sheet to thereby position it in the vertical direction or direction of sheet conveyance. Subsequently, the jogger fence 53 positions the sheet in the horizontal direction or direction perpendicular to the direction of sheet conveyance. During the interval between consecutive jobs, i.e., between the last sheet of a sheet stack and the first sheet of the next sheet stack, a controller 350 (see FIG. 16) sends a staple signal to the edge stapler S1, causing the stapler S1 to staple a sheet stack. The stapled sheet stack is immediately conveyed to the outlet roller pair 6 by a belt or timing belt 52 and then driven out to the tray 202, which is located at a receiving position.

Figure 7:
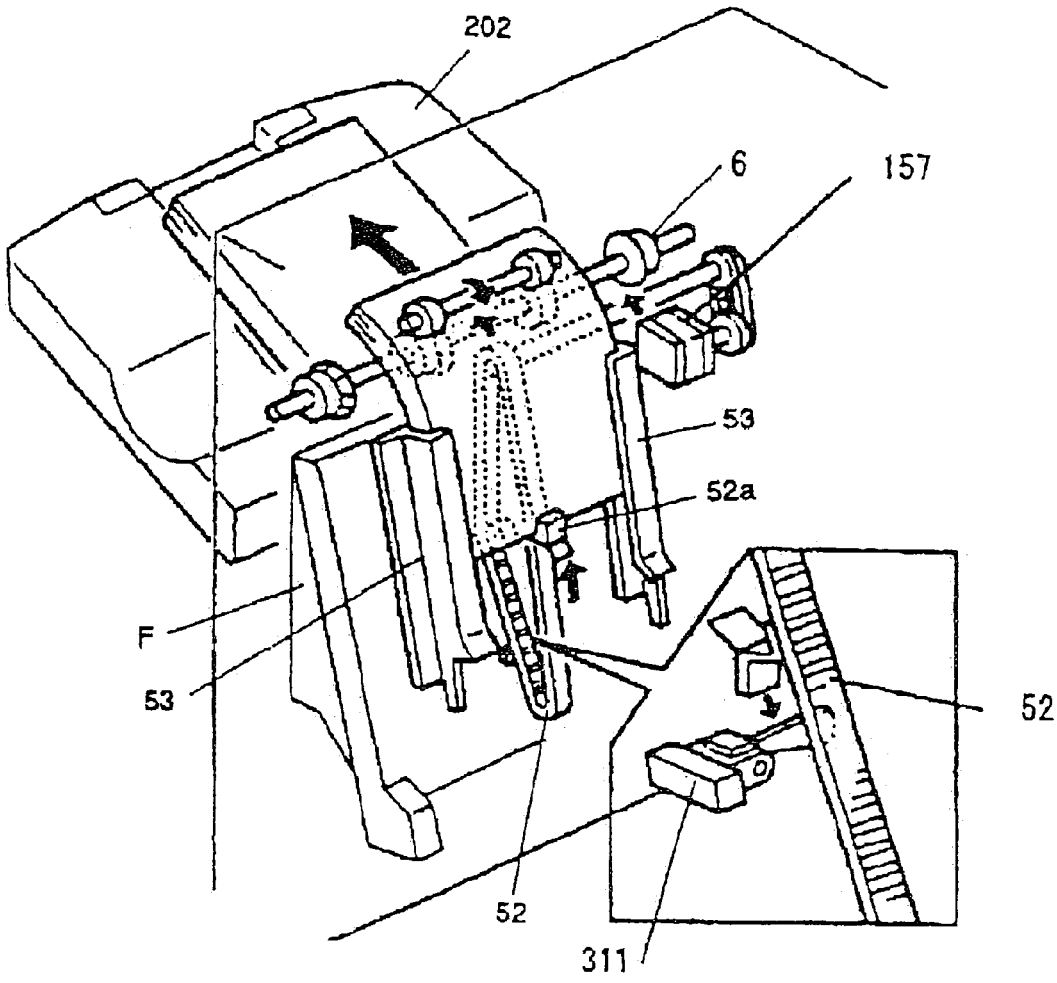
FIG. 7 is a perspective view showing a mechanism included in the sheet finisher for discharging a sheet stack.

As shown in FIG. 7, a belt HP (Home Position) sensor 311 senses a hook 52*a* brought to a home position. More specifically, two hooks 52*a* are position on the outer surface of the belt 52 in such a manner as to face each other, and each turns on and turns off the belt HP sensor 311. The hooks 52*a* alternately move sheet stacks brought to the staple tray F one after another. If desired, the belt 52*a* may be moved in the reverse direction, as needed, so that the two hooks 52*a* can position the leading edge of the sheet stack laid on the staple tray F with their backs. In this sense, the hooks 52*a* play the role of positioning means for positioning a sheet stack in the direction of sheet conveyance as well.

Figure 5:
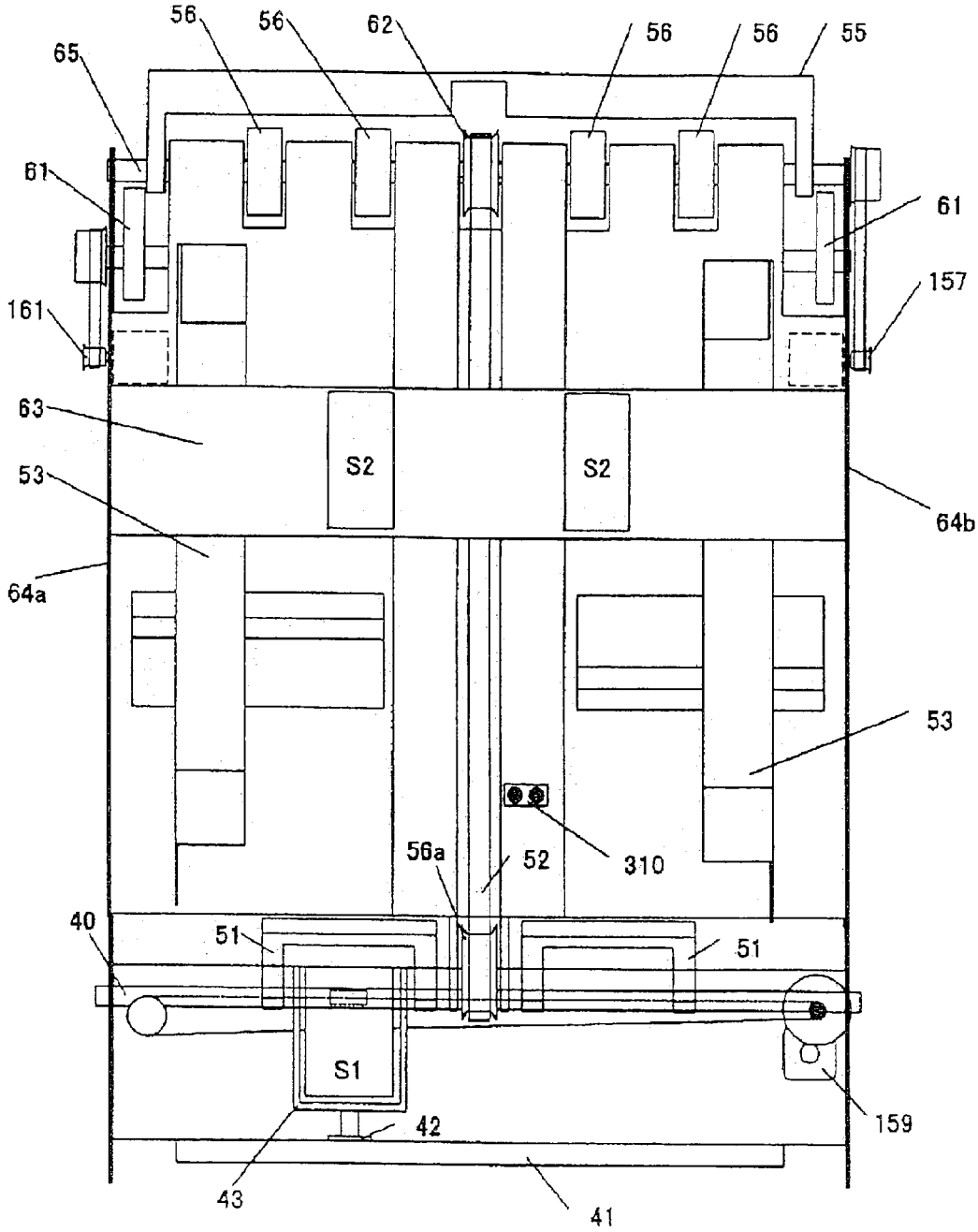
FIG. 5 is a front view showing a staple tray included in the sheet finisher, as seen in a direction perpendicular to a sheet conveying surface thereof.
Figure 6:
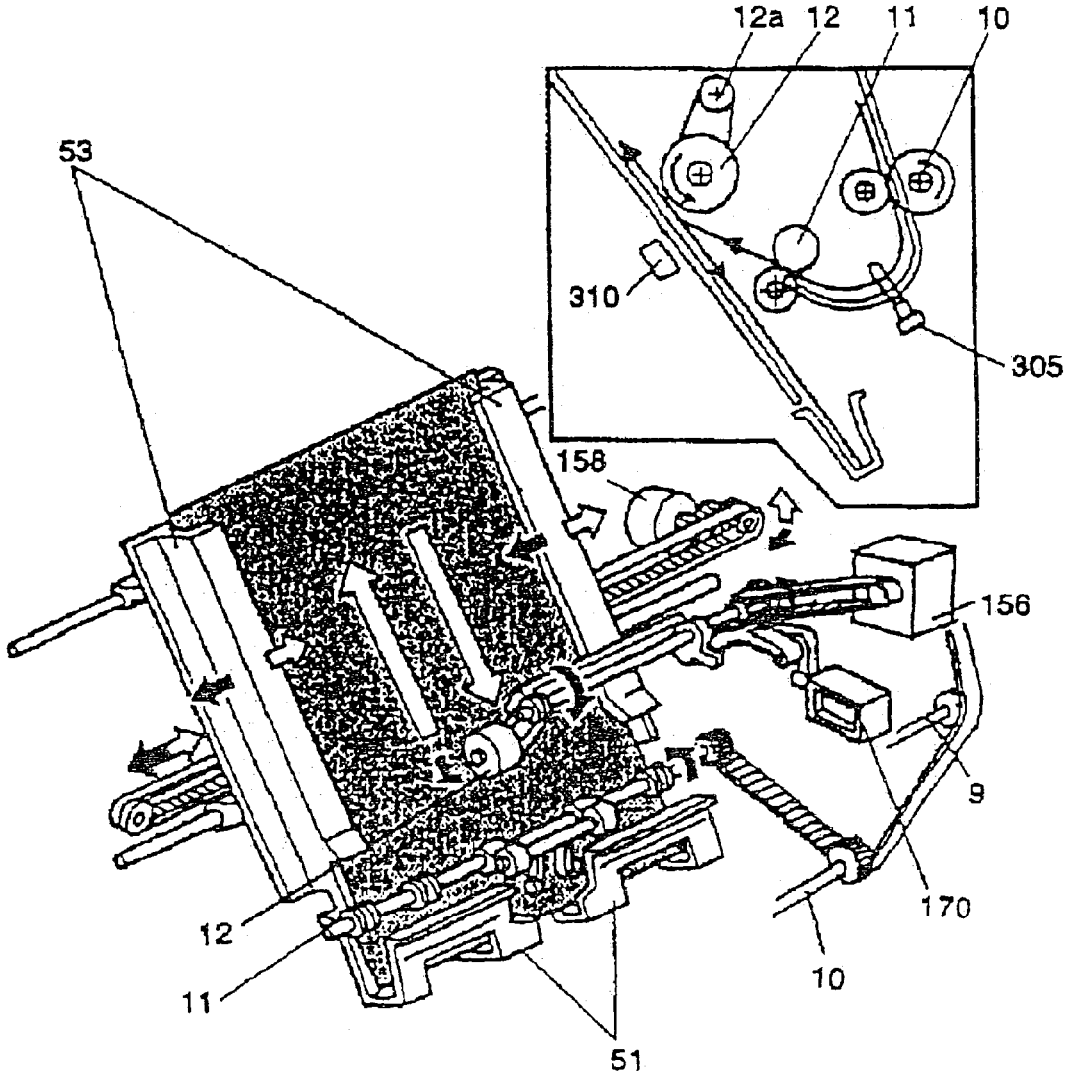
FIG. 6 is an isometric view showing the staple tray, a driving mechanism associated therewith, and an exclusive drive source assigned to a knock roller.

As shown in FIG. 5, a motor 157 drives a drive shaft 65 for causing the belt 52 to move. The belt 52 and a drive pulley 62 over which the belt 52 is passed are positioned on the shaft 65 at the center in the widthwise direction of a sheet. Rollers 56 are affixed to the drive shaft 65 symmetrically with respect to the drive pulley 62. The rollers 56 each are rotated at a higher peripheral speed than the belt 52.

The output torque of the motor 157 is transferred to the belt 52 via a timing belt and timing pulleys. The drive pulley or timing pulley 62 and rollers 56 are mounted on a single shaft 65. When the relation in speed between the rollers 56 and belt 52 should be varied, an arrangement may be made such that the rollers 56 are capable of idling on the shaft 65 while the output torque of the motor 157 is divided and transferred to the rollers 56. This arrangement provides the setting of a speed reduction ratio with freedom.

The circumferential surfaces of the rollers 56 are formed of rubber or similar material having high frictional resistance. The rollers 56 exert a conveying force on a sheet or a sheet stack in cooperation with driven rollers 57, which are pressed against the rollers 56 due to its own weight or by a biasing force. There are also shown in FIG. 5 a front and a rear side wall 64*a* and 64*b* included in the sheet finisher PD, a stack branch motor for driving the movable guide 55, and cams 61 included in the drive mechanism.

As shown in FIG. 6, a knock solenoid 170 causes the knock roller 12 to swing about a fulcrum 12*a* like a pendulum, thereby causing a sheet arrived at the staple tray F to abut against a rear fence 51. In FIG. 6, the knock roller 12 is rotated in the counterclockwise direction. The knock roller 12 is driven by a knock motor 156, which is driven by a CPU 360 (see FIG. 16) via a motor driver independently of the other drive sources, as will be described specifically later. In the illustrative embodiment, the knock motor 156 is implemented as a stepping motor. The knock solenoid 170 is also driven by the CPU 360 via a driver.

The jogger fences 53 are driven back and forth by a reversible jogger motor 158 via a timing belt in the direction perpendicular to the direction of sheet conveyance.

As shown in FIG. 5, a reversible stapler shift motor 159 causes the edge stapler S1 to move via a timing belt 46 (see FIG. 10) in the widthwise direction of a sheet, thereby stapling a sheet stack at a preselected edge position. A stapler HP sensor 312, FIG. 1, responsive to the home position of the edge stapler S1 is positioned at one end of the movable range of the edge stapler S1. The edge-stapling position is controlled on the basis of the displacement of the edge stapler S1 from the home position.

Figure 8:
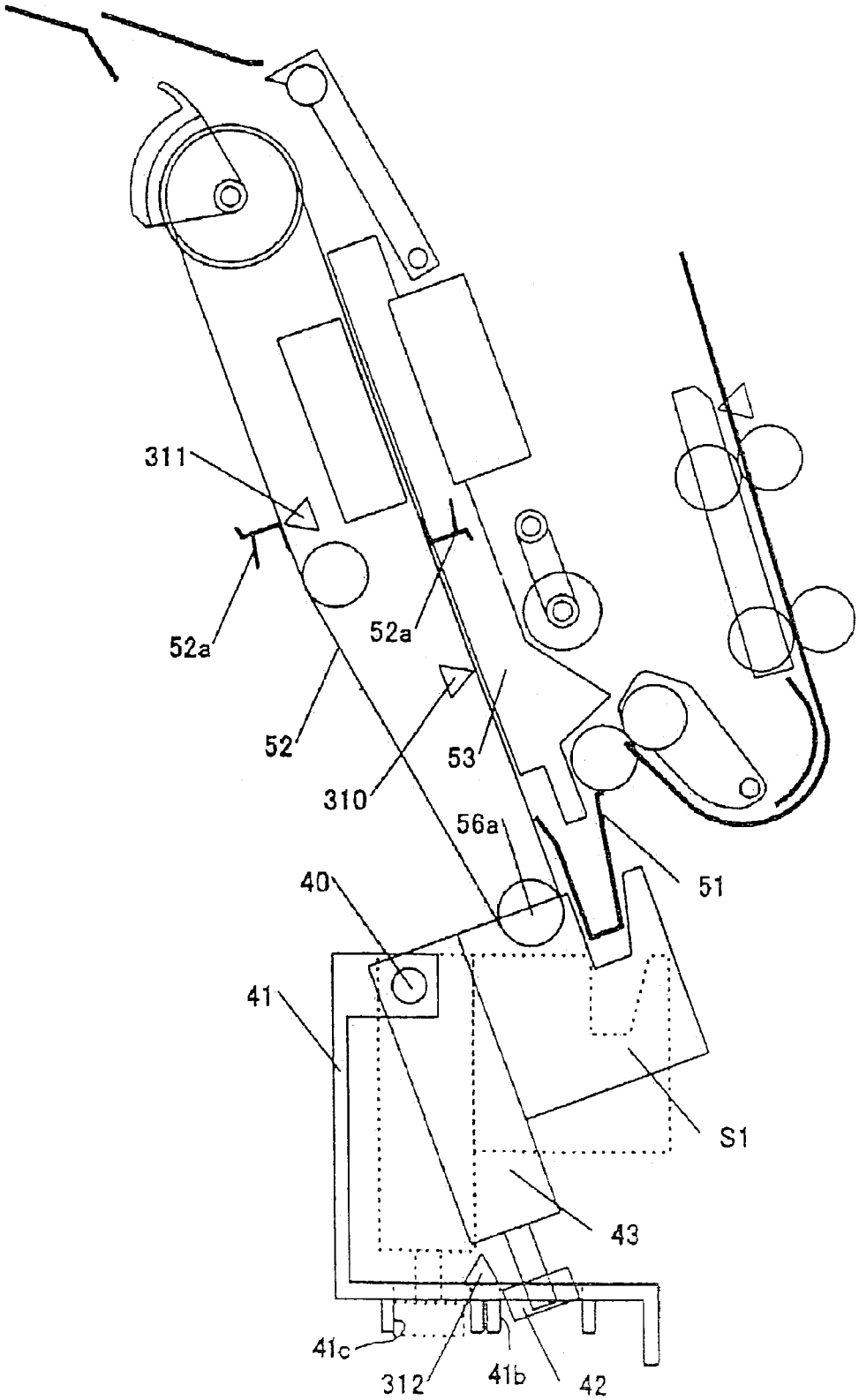
FIG. 8 is a front views showing a relation between the staple tray, a stapler, and a guide shaft shown in FIG. 1.
Figure 9:
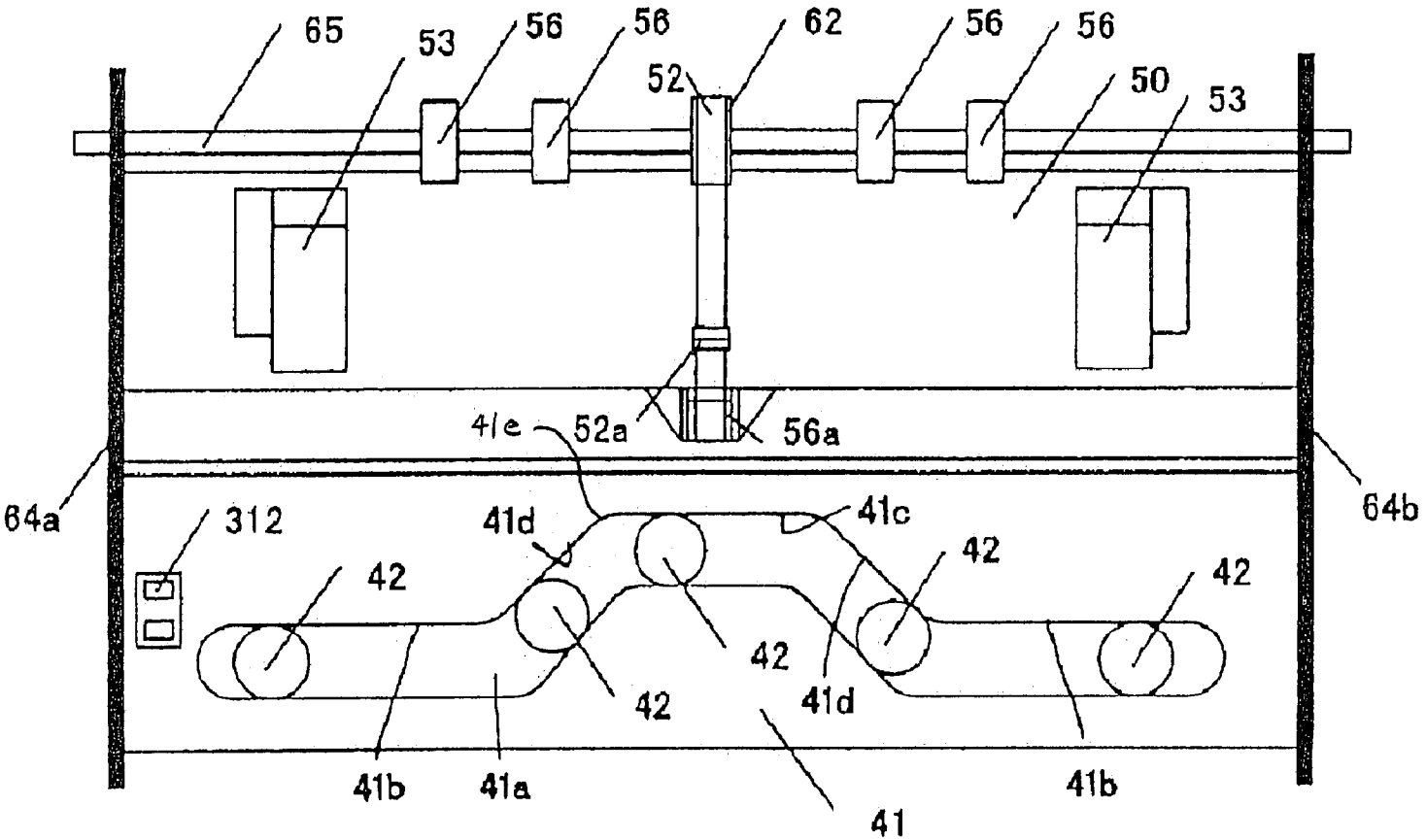
FIG. 9 is a plan view showing a relation between the staple tray, a guide stay, and a cam groove.
Figure 10:
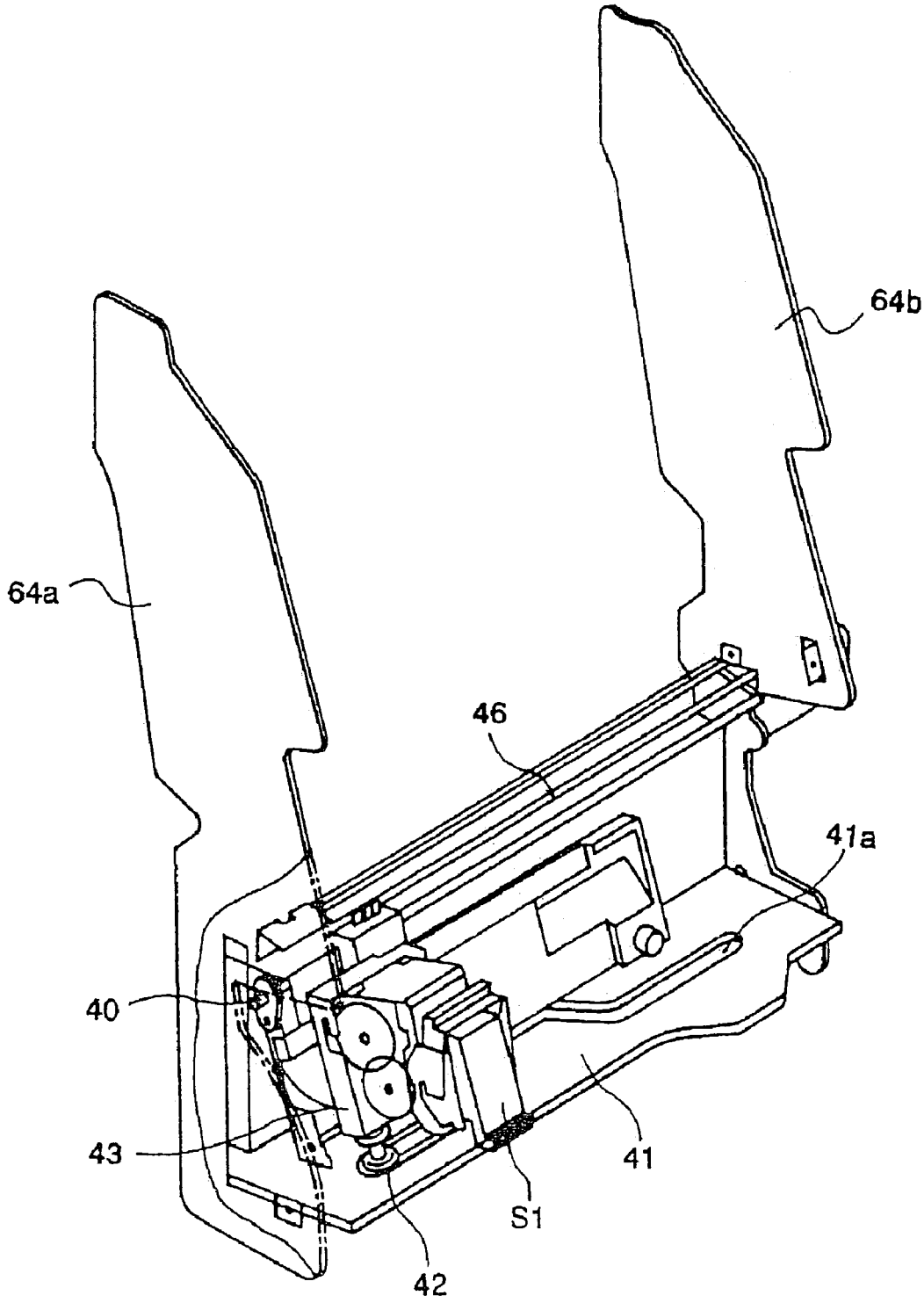
FIG. 10 is a perspective view showing a relation between the guide shaft, the stapler, the guide stay, and the cam groove.

More specifically, as shown in FIGS. 8 through 10, the edge stapler S1 moves in the direction perpendicular to the direction of sheet conveyance on a guide shaft 40, which is parallel to the rear fence 51. The edge stapler S1 is guided by a cam slot or stapler guide 41*a* formed in a guide stay 41. The cam slot 41*a* is configured to cause the edge stapler S1 to move in the following manner. The edge stapler S1 is angularly moved about the guide shaft 40 to a position indicated by a phantom line in FIG. 8 when moving below the lower edge of the staple tray 50, FIG. 9, and a discharge idle pulley 56*a*, and then returned to a position indicated by a solid line in FIG. 8.

Figure 11:
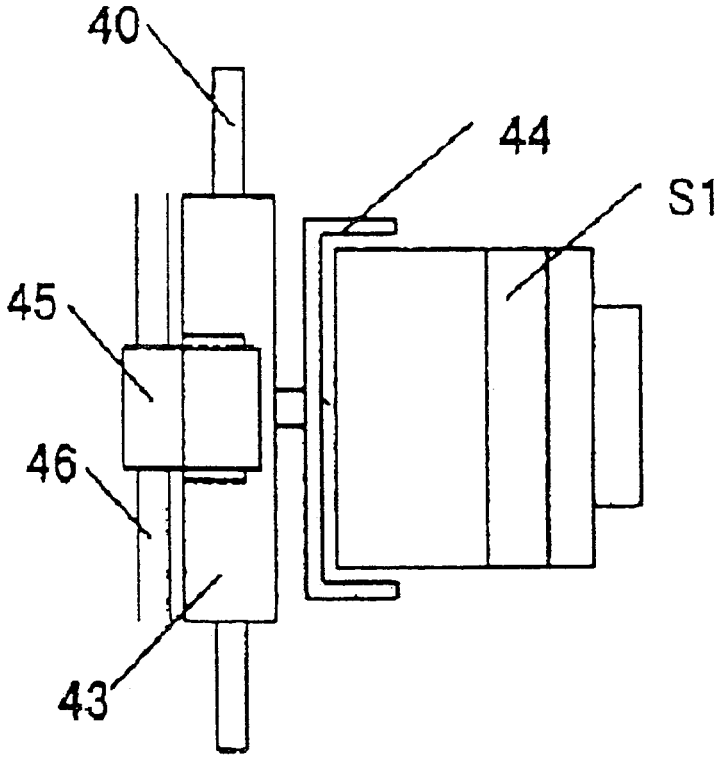
FIGS. 11 and 12 are respectively a plan view and a front view showing a relation between the guide shaft, the stapler, a bracket and a stapler rotation bracket shown in FIG. 1.
Figure 12:
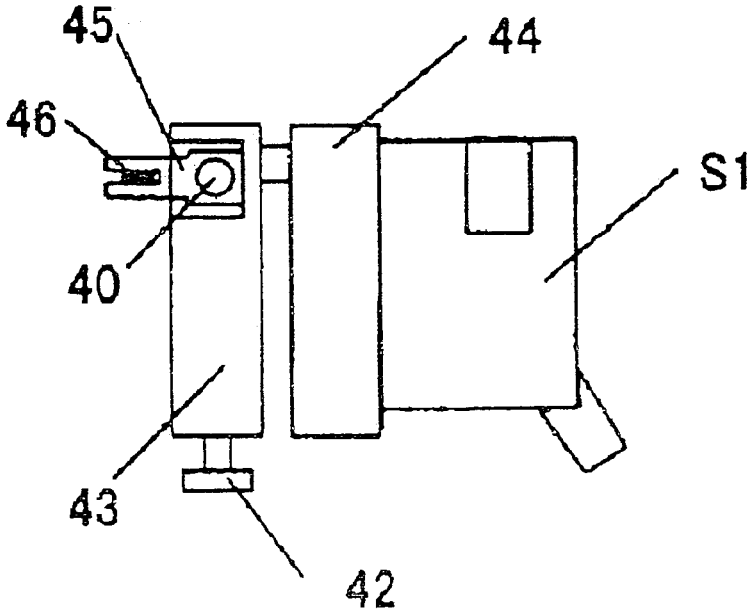

As shown in FIGS. 11 and 12, a member 45 is affixed to the timing belt 46, nipped by a stapler shift bracket 43, and movable on the guide shaft 40 in the widthwise direction of a sheet. In this configuration, when the member 45 is moved along the guide shaft 40, the bracket 43, a guide roller 42 mounted on the bracket 43, a stapler rotation bracket 44 and the edge stapler S1 move integrally with each other.

The stapler shift bracket 43, stapler rotation bracket 44 and edge stapler S1 angularly move along the locus of the guide roller 42, which roll on cam surfaces 41*b*, 41*d* and 41*c* forming part of the cam slot 41*a*. However, the member 45 does not angularly move because it is affixed to the timing belt 46.

Figure 13:
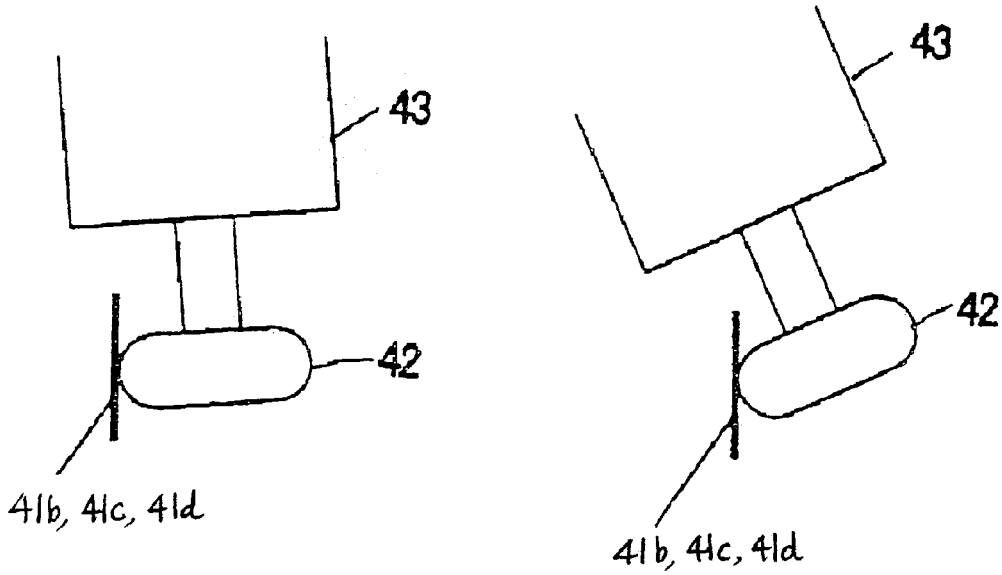
FIG. 13 shows a relation between a cam surface and a guide roller included in the sheet finisher.
Figure 14:
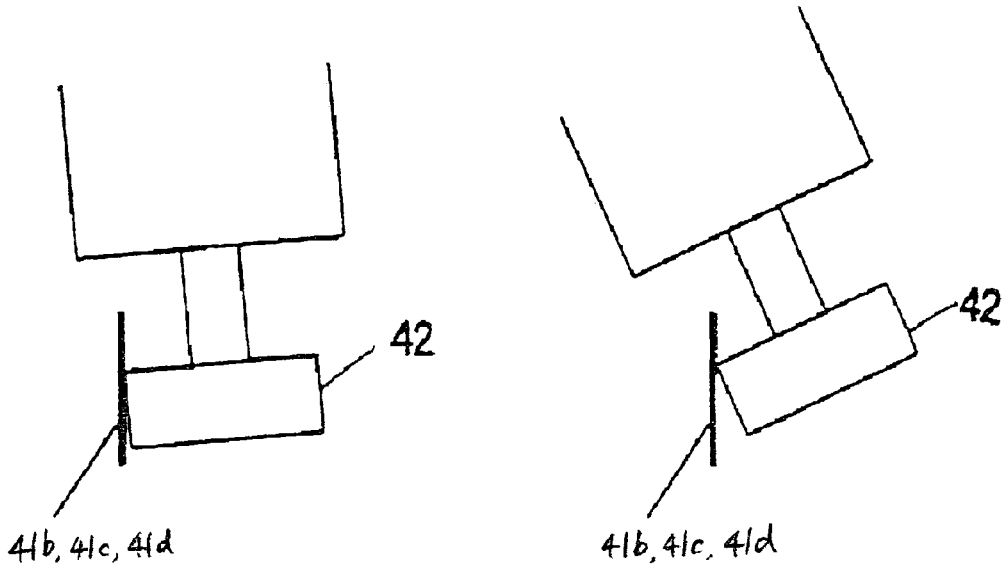
FIG. 14 shows a comparative relation between the cam surface and the guide roller.

As shown in FIG. 13, the surface of the guide roller 42 contacting the cam surfaces 41*b* through 41*d* is provided with curvature, so that the contact point between the guide roller 42 and cam surfaces 41*b* through 41*d* varies when the edge stapler S1 angularly moves. For comparison, FIG. 14 shows a condition wherein the guide roller 42 not provided with curvature contacts the cam surfaces 41*b* through 41*d*. As shown, the guide roller 42 constantly contacts the cam surfaces 41*b* through 41*d* at its edge. The guide roller 42 may, of course, be replaced with a spherical, rotary body.

As FIGS. 9 and 10 indicate, the guide roller 42 contacts and rolls on the cam surface 41*b* (first cam surface 41*b* hereinafter), so that the edge stapler S1 moves in the direction perpendicular to the direction of sheet conveyance for stapling the edge of a sheet stack. At this instant, as shown in FIG. 8, the edge stapler S1 slidably hangs down from the guide shaft 40 and causes the guide roller 42 to contact the first cam surface 41*b* due to gravity and roll thereon while sandwiching the edge portion of the sheet stack to be stapled. In this condition, the position of the stapler S1 is determined by the position of the guide shaft 40 and the position of the guide roller 42 contacting the first cam surface 41*b*.

Figure 15:
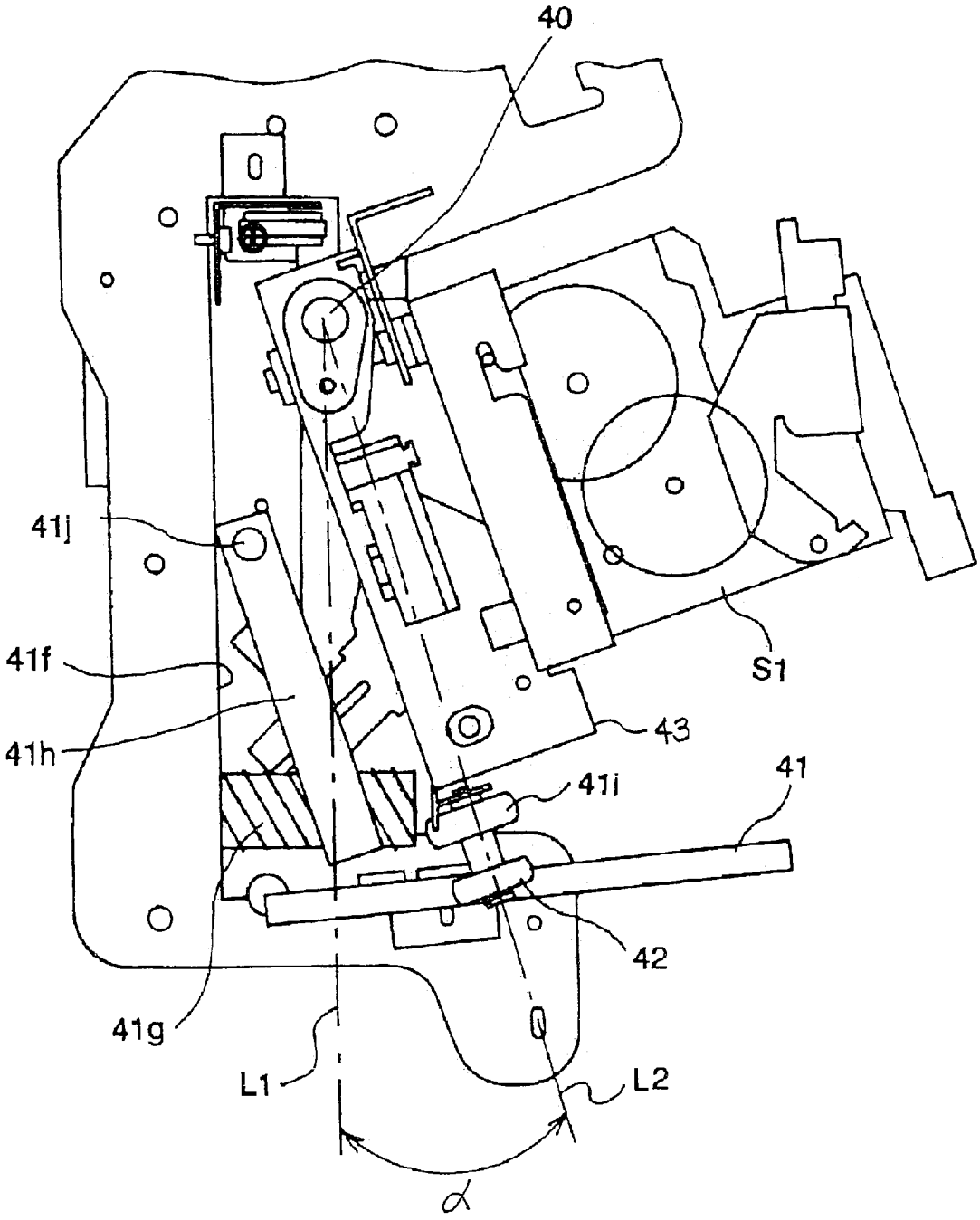
FIG. 15 is a fragmentary front view showing a relation between the guide shaft, the stapler, the guide stay, an auxiliary plate and a compression spring shown in FIG. 1.

In the illustrative embodiment, in the position indicated by the solid line in FIG. 8, the guide roller 42 rolls on the first cam surface 41*b* with the bracket 43 being inclined (see line L2, FIG. 15, as also shown in FIG. 9. On the other hand, in the position indicated by the phantom line in FIG. 8, the guide roller 42 rolls on the cam surface 41*c* (second cam surface 41*c* hereinafter) without the bracket 43 being inclined (line L1, FIG. 15; perpendicular direction or direction of gravity). When the guide roller 42 rolls on the first cam surface 41*b*, the edge stapler S1 moves while sandwiching the sheet stack and can therefore staple the sheet stack at a preselected position. When the guide roller 42 rolls on the second cam surface 41*c*, the edge stapler S1 is retracted from the discharge idler pulley 56*a*.

As stated above, the guide roller 42 rolls on the cam surfaces 41*b* and 41*c* under the action of gravity, causing the edge stapler S1 to angularly move over an angle α between the lines L1 and L2, FIG. 15. However, the edge stapler S1 has a large mass. Consequently, when the guide roller 42 rolled on the first cam surface 41*b* rolls on the inclined cam surface 41*d* (third cam surface 41*d* hereinafter) preceding the second cam surface 41*c*, acceleration ascribable to the weight of the edge stapler S1 increases and is apt to exert a heavy shock on the second cam surface 41*c*. This shock causes the guide roller 42 to hit against the surface of the guide slot 41*a* opposite to the second cam surface 41*c*. As a result, the guide roller 42 moves along the guide slot 41*a* while repeatedly hitting against the opposite surfaces of the cam slot 41*a*. The above shock not only produces noise, but also causes the structural elements to vibrate and thereby lowers reliability of operation.

Further, when the guide roller 42 rolls from the second cam surface 41*c* to the other third cam surface 41*d* preceding the other first cam surface 41*b* located at the stapling side, the guide roller 41 hits against a corner 41*e* between the cam surfaces 41*c* and 41*d*, also resulting in a heavy shock. Moreover, a great force is necessary for moving the stapler S1 having a large mass along the third cam surface 41*d*, so that the stapler motor 159 must output a great torque and therefore needs a great drive current.

In light of the above, as shown in FIG. 15, a compression spring 41*g* and an auxiliary plate 41*h* are provided on the vertical edge 41*f* of the guide stay 41 while a roller 41*i* coaxial with the guide roller 42 is provided that rolls on the auxiliary plate 41*h*. The auxiliary plate 41 is angularly movable about a shaft 41*j* while the compression spring 42*g* damps the angular movement. Further, when the guide roller 42 moves from the second cam surface 41*c* to the third cam surface 41*d*, the impact to act on the third cam surface 41*e* is absorbed by the compression spring 42*g*. Therefore, a small driving force suffices for causing the guide roller 42 to easily move from the third cam surface 41*d* to the first cam surface 41*b*. This successfully reduces the output torque and therefore drive current required of the stapler motor 159, contributing to energy saving.

The compression spring 41*g* may be replaced any other suitable mechanism so long as it can damps the angular movement of the auxiliary plate 41*h* and reduce the motor output torque necessary for causing the guide roller 42 to roll on the third cam surface 41*d*.

As shown in FIG. 15, assume that the vertical line L1, extending from the axis of the guide shaft 40, is one axis while a line extending from the above axis perpendicular to the vertical line L1 (horizontal line) is another axis. Then, the angle α between the lines L1 and L2 lies between the above two axes, i.e., in the fourth quadrant, obviating wasteful angular movement.

Five different sheet discharge modes are available with the illustrative embodiment in accordance with the finishing mode, as will be described hereinafter. In a non-staple mode a, sheets are sequentially discharged to the upper tray 201 via the paths A and B. In a non-staple mode b, sheets are sequentially delivered to the shift tray 202 via the paths A and C. In a sort/stack mode, sheets are sequentially delivered to the shift tray 202 via the paths A and C; the shift tray 202 is repeatedly shifted in the direction perpendicular to the direction of sheet discharge to thereby sort the sheets. In a staple mode, sheets are delivered to the staple tray F via the paths A and D, positioned and stapled on the tray F, and then discharged to the shift tray 202 via the path C. Further, in a center staple, bind mode, sheets are delivered to the staple tray F via the paths A and D, positioned and stapled at the center on the tray F, folded at the center on the fold tray G, and then driven out to the lower tray 203 via the path H. The staple mode will be described in detail hereinafter. The other modes will not be described specifically.

In the staple mode, a sheet sheered from the path A to the path D by the path selectors 15 and 16 is conveyed to the staple tray F by the rollers 7, 9 and 10 and stapler inlet roller 11. When a preselected number of sheets are stacked on the staple tray F, the edge stapler S1 staples the sheet stack. Subsequently, the hook 52*a* lifts the stapled sheet stack to the downstream side in the direction of sheet conveyance, and then the shift outlet roller 6 conveys it to the tray 202.

More specifically, as shown in FIG. 6, the jogger fences 53 each move from its home position to a stand-by position 7 mm remote from the width of a sheet. When the stapler inlet roller 11 conveys a sheet until the trailing edge of the sheet moves away from the staple discharge sensor 305, each jogger fence 53 is further moved by 5 mm inward of the stand-by position. The staple discharge sensor 305, sensed the tailing edge of the sheet, sends its output to the CPU 360. In response, the CPU 360 starts counting pulses output from a conveyance motor, not shown, which drives the stapler inlet roller 11. On counting a preselected number of pulses, the CPU 360 turns on the knock solenoid 170 for thereby causing the knock roller 12 to knock the sheet, as stated earlier. The sheet is therefore abutted against the rear fence 51 and positioned thereby. Every time a sheet moves away from the inlet sensor 101 or the staple discharge sensor 305, the CPU 360 increments the count of sheets.

On the elapse of a preselected period of time since the turn-off of the knock solenoid 170, the jogger motor 158 moves each jogger fence 53 further inward by 2.6 mm, thereby positioning the sheet in the horizontal direction. Subsequently, the jogger motor 158 moves each jogger fence 53 outward by 7.6 mm to the stand-by position and causes it to wait for the next sheet. This operation is repeated up to the last sheet of a job. Thereafter, the jogger motor 158 again moves each jogger fence 53 inward by 7 mm to thereby nip the opposite edges of the sheet stack. On the elapse of a preselected period of time since the above step, the stapler motor drives the edge stapler S1 for thereby stapling the edge of the sheet stack. If the sheet stack should be stapled at two or more positions, then the staple motor 159 further moves the edge stapler S1 to an adequate position along the lower edge of the sheet stack.

After the stapling operation, the discharge motor 157 is driven to move the belt 52 with the result that the hook 52*a* lifts the stapled sheet stack. At the same time, the discharge motor is driven to rotate the shift discharge roller 6, so that the sheet stack lifted by the hook 52*a* is conveyed by the roller 6. At this instant, the jogger fences 53 are controlled in a different manner in accordance with the number or the size of sheets stapled together. For example, if the number or the size of sheets is smaller than a preselected value, then the jogger fences 53 continuously nip the sheet stack therebetween when the sheet stack is being lifted by the hook 52*a*.

Subsequently, when the CPU 360 counts a preselected number of pulses after a sheet presence/absence sensor 310 or the belt HP sensor 311 has outputs a sense signal, the jogger fences 53 are moved outward by 2 mm to release the sheet stack. The preselected number of pulses corresponds to an interval between the time when the hook 52*a* contacts the trailing edge of the sheet stack and the time when the hook 52*a* moves away from the ends of the jogger fences 53.

If the number or the size of the sheets stapled together is larger than the preselected value, then the jogger fences 53 are moved outward by 2 mm before the discharge of the stapled sheet. In any case, as soon as the sheet stack moves away from the jogger fences 53, the jogger fences 53 are further moved outward by 5 mm to the stand-by positions to prepare for the next sheet stack. Restraint to act on the sheet stack may be adjusted on the basis of the distance between the sheet stack and the jogger fences 53.

Figure 16:
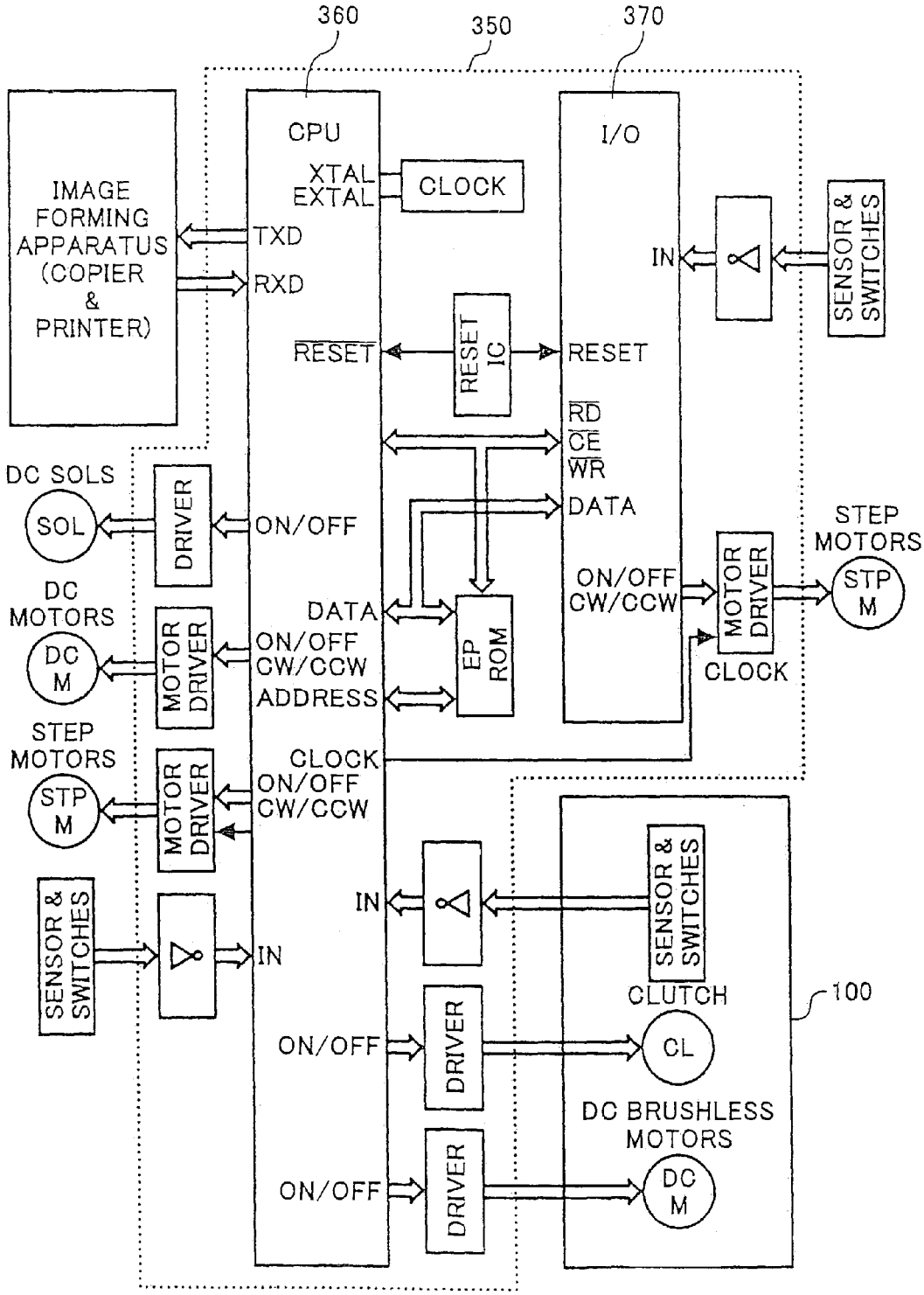
FIG. 16 is a schematic block diagram showing a control system included in the illustrative embodiment, particularly a controller for controlling the sheet finisher.

As shown in FIG. 16, the controller 350 is implemented as a microcomputer including an I/O (Input/Output) interface in addition to the CPU 360. The outputs of switches arranged on a control panel, which is mounted on the body of the image forming apparatus PR, and the outputs of the inlet sensor 301, upper sheet outlet sensor, shift discharge sensor 303, prestack sensor, stapler inlet sensor 305, sheet presence/absence sensor 301, belt HP sensor 311, staple HP sensor 312, jogger fence HP sensor, stack arrival sensor 321, movable rear fence HP sensor, fold sensor, lower outlet sensor, sheet surface sensor 330 and so forth are input to the CPU 360 via the I/O interface 370.

The CPU 360 controls, in accordance with the above inputs, the tray motor 168, guide plate open/close motor shift motor 169, knock motor 156, solenoids including the knock solenoid 170, motor for driving the rollers, outlet motor for controlling outlet motors, belt motor 157, stapler shift motor 159, jogger motor 158, stack branch motor 161 and so forth. The CPU 360 counts the output pulses of the staple conveyance motor assigned to the stapler outlet roller 11 for controlling the knock solenoid 170 and jogger motor 158.

An alternative embodiment of the present invention will be described with reference to FIGS. 17 and 18. In the previous embodiment, the edge stapler S1 is moved along the guide slot or stapler guide 41*a* and shifted between the stapling position and the retracted position thereby. In the alternative embodiment, the guide shaft 40 is configured to serve as a stapler guide shaft.

Figure 17:
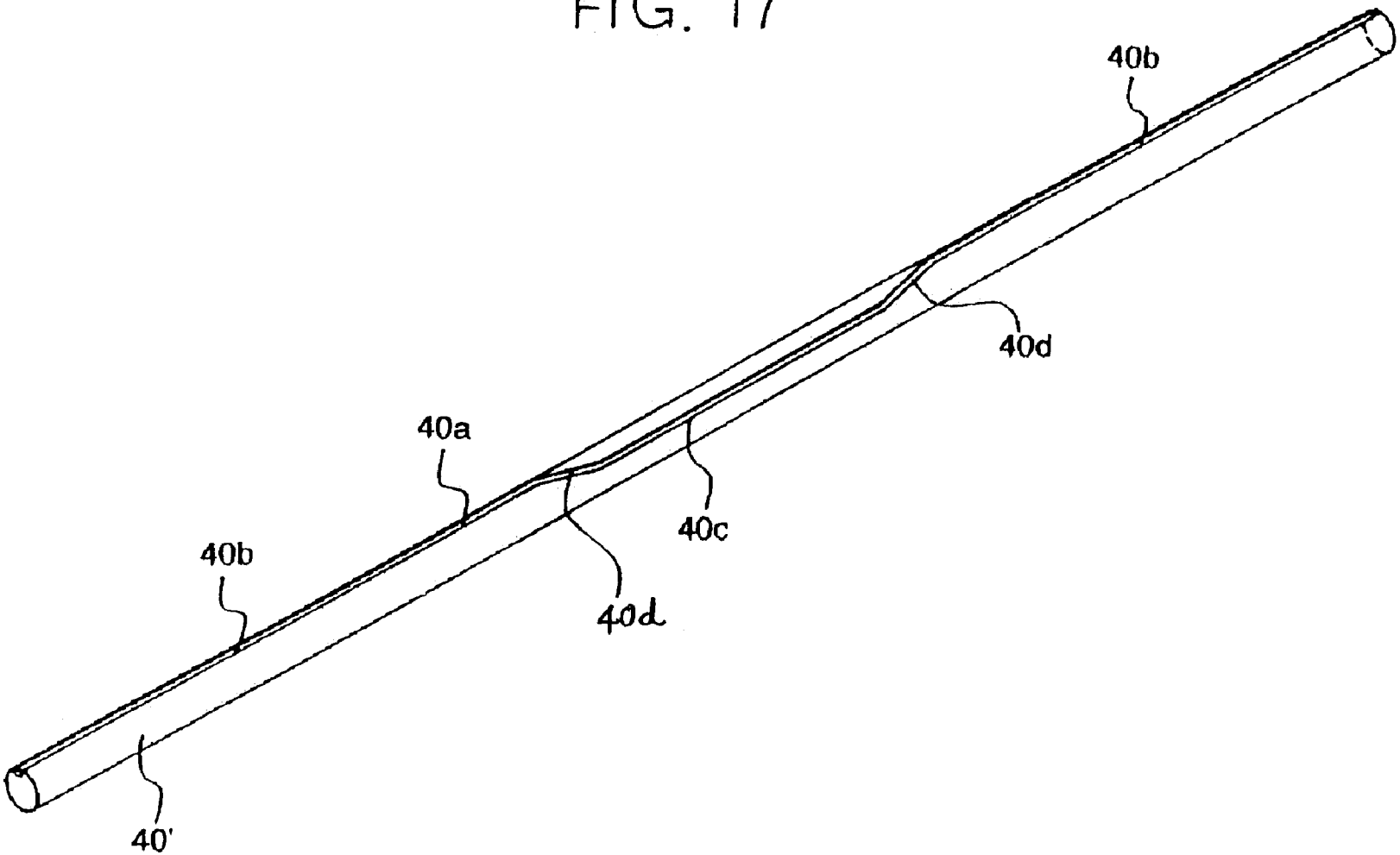
FIG. 17 is an isometric view showing a guide shaft representative of an alternative embodiment of the present invention.
Figure 18:
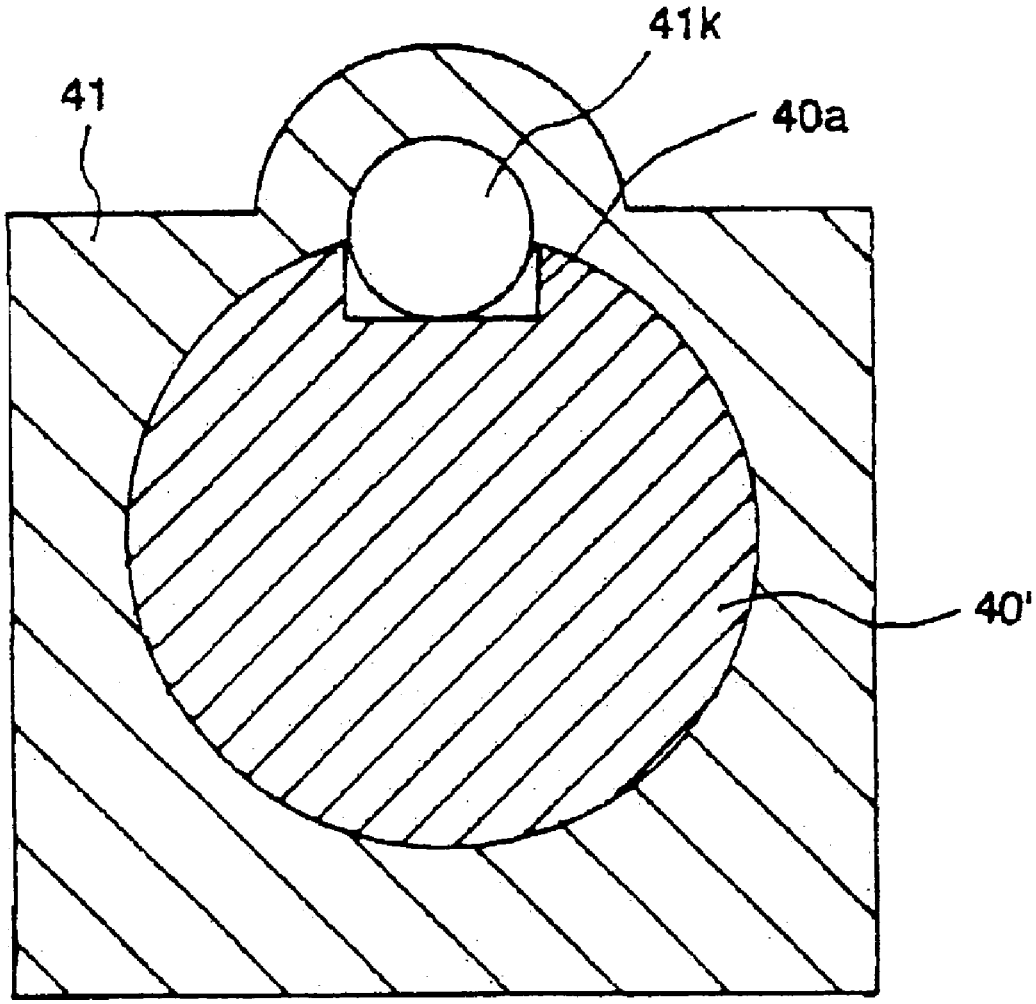
FIG. 18 is a section showing a mechanism included in the alternative embodiment for causing the guide stay to slide on the guide shaft.

As shown in FIGS. 17 and 18, the guide shaft, labeled 40', is formed with a guide groove or cam groove 40*a* corresponding to the cam slot 41*a* of the previous embodiment. The guide groove 40*a* is made up of first guide grooves 40*b* corresponding to the first cam surfaces 41*b*, second guide grooves 40*c* corresponding to the second cam surface 41*c*, and third cam grooves 40*d* corresponding to the third cam surfaces 41*d*. The guide grooves 40*b* through 40*d* are contiguous with each other.

As shown in FIG. 18, a guide member (bearing) is provided with a ball 41*k*. When the guide stay 41 moves along the guide groove 40*a* together with the ball 41*k*, the edge stapler S1 is shifted between the position at which it moves while sandwiching a sheet stack and the position retracted from the idler pulley 56*a*, as stated earlier. In the illustrative embodiment, the edge stapler S1 moves back and forth in the direction perpendicular to the direction of sheet conveyance while being retracted from the idle pulley 56*a* as in the previous embodiment. Again, the guide shaft 40' supports the stapler S1 alone, so that the damping means included in the previous embodiment should preferably be used. As for the rest of the configuration, the illustrative embodiment is identical with the previous embodiment.

The illustrative embodiment makes it needless to position a cam below the stapler S1 for thereby saving space in the up-and-down direction.

In summary, in accordance with the present invention, stapling means can move in the direction perpendicular to the direction of sheet conveyance while being retracted from a pulley or similar rotary member. A cam surface and a member contacting it are prevented from wearing due to friction and noticeably reducing the life of the stapling means. In addition, a load to act on the stapling means during movement is reduced.

Further, a single guide shaft can guide both of the above movement and angular movement of the stapling means, so that the number of parts is reduced. Moreover, the configuration of the present invention is simple and therefore low cost.

Various modifications will become possible for those skilled in the art after receiving the teachings of the present disclosure without departing from the scope thereof.

What is claimed is:

1. A sheet finisher for executing preselected processing with a sheet introduced into said sheet finisher and then discharging said sheet, said sheet finisher comprising:

stacking means for temporarily stacking sheets sequentially delivered thereto;

jogging means for jogging the sheets within said stacking means;

stapling means for stapling a sheet stack jogged in said stacking means;

a guide shaft supporting said stapling means such that said stapling means is movable along said guide shaft in a direction perpendicular to a direction of sheet conveyance and angularly pivots about a single axis, said single axis being an axis of said guide shaft; and moving means for moving said stapling means along said guide shaft in the direction perpendicular to the direction of sheet conveyance, said moving means includes cam means for controllably regulating movement of said stapling means, said cam means being fixedly mounted on a body of said sheet finisher, wherein said stapling means angularly pivots about the axis of said guide shaft by means of said cam means as said stapling means moves along said guide shaft.

2. The sheet finisher as claimed in claim 1, wherein said moving means causes only said stapling means to angularly move about said guide shaft.

3. The sheet finisher as claimed in claim 2, wherein said moving means further comprises a roller or a spherical contact member that contacts a cam surfaced of said cam means and is rollable.

4. The sheet finisher as claimed in claim 3, wherein a surface of said contact member contacting said cam surface is provided with an convex curvature.

5. The sheet finisher as claimed in claim 2, wherein said stapling means angularly moves about said guide shaft in a range delimited by a vertical line and a horizontal line extending from said guide shaft.

6. The sheet finisher as claimed in claim 2, further comprising means for damping an angular movement of said stapling means in a direction of gravity, but assisting an angular movement of said stapling means in a direction opposite to the direction of gravity.

7. The sheet finisher as claimed in claim 1, wherein said moving means causes only said stapling means to angularly move about said guide shaft due to gravity.

8. The sheet finisher as claimed in claim 7, wherein said moving means further comprises a roller or a spherical contact member that contacts a cam surfaced of said cam means and is rollable.

9. The sheet finisher as claimed in claim 8, wherein a surface of said contact member contacting said cam surface is provided with an outward curvature.

10. The sheet finisher as claimed in claim 7, wherein said stapling means angularly moves about said guide shaft in a range delimited by a vertical line and a horizontal line extending from said guide shaft.

11. The sheet finisher as claimed in claim 7, further comprising means for damping an angular movement of said stapling means in a direction of gravity, but assisting an angular movement of said stapling means in a direction opposite to the direction of gravity.

12. The sheet finisher as claimed in claim 1, wherein a cam groove for causing said stapling means to angularly move is formed in a circumference of said guide shaft.

13. The sheet finisher as claimed in claim 12, wherein said stapling means angularly moves about said guide shaft in a range delimited by a vertical line and a horizontal line extending from said guide shaft.

14. The sheet finisher as claimed in claim 12, further comprising means for damping an angular movement of said stapling means in a direction of gravity, but assisting an angular movement of said stapling means in a direction opposite to the direction of gravity.

15. The sheet finisher as claimed in claim 1, wherein said moving means further includes a motor having an output shaft configured to be driven in rotation about a drive axis that is perpendicular to said axis of said guide shaft, said output shaft being configured to drive said stapling means along said guide shaft.

16. An image forming system comprising:

an image forming apparatus configured to form a toner image on a recording medium in accordance with input image data; and a sheet finisher for executing preselected processing with the sheet introduced into said sheet finisher from said image forming apparatus and then discharging said sheet, said sheet finisher comprising:

stacking means for temporarily stacking sheets sequentially delivered thereto;

jogging means for jogging the sheets within said stacking means;

stapling means for stapling a sheet stack jogged in said stacking means;

a guide shaft supporting said stapling means such that said stapling means is movable along said guide shaft in a direction perpendicular to a direction of sheet conveyance and angularly pivots about a single axis, said single axis being an axis of said guide shaft; and moving means for moving said stapling means along said guide shaft in the direction perpendicular to the direction of sheet conveyance, said moving means includes cam means for controllably regulating movement of said stapling means, said cam means being fixedly mounted on a body of said sheet finisher, wherein said stapling means angularly pivots about the axis of said guide shaft by means of said cam means as said stapling means moves along said guide shaft.

17. A sheet finisher comprising:

a sheet stacking device configured to receive sheets sequentially delivered thereto;

a stapler configured to staple a sheet stack in said sheet stacking device;

a guide shaft supporting said stapler, wherein said stapler is movable along said guide shaft in a direction perpendicular to a direction of sheet conveyance and angularly pivots about a single axis, said single axis being an axis of said guide; and a moving device configured to move said stapler along said guide shaft in the direction perpendicular to the direction of sheet conveyance, said moving device includes a cam configured to controllably regulate movement of said stapler, said cam being fixedly mounted on a body of said sheet finisher, wherein said stapler angularly pivots about the axis of said guide shaft by means of said cam as said stapler moves along said guide shaft.

18. The sheet finisher as claimed in claim 17, wherein said moving device further includes a motor having an output shaft configured to be driven in rotation about a drive axis that is perpendicular to said axis of said guide shaft, said output shaft being configured to drive said stapler along said guide shaft.

19. A sheet finisher comprising:

a sheet stacking device configured to receive sheets sequentially delivered thereto;

a jogging device configured to jog the sheets received within said sheet stacking device;

a stapler configured to staple a sheet stack jogged in said sheet stacking device;

a guide shaft supporting said stapler such that said stapler is movable along said guide shaft in a direction perpendicular to a direction of sheet conveyance and angularly pivots about a single axis, said single axis being an axis of said guide shaft; and a moving device configured to move said stapler along said guide shaft in the direction perpendicular to the direction of sheet conveyance, said moving device includes a cam configured to controllably regulate movement of said stapler, said cam being fixedly mounted on a body of said sheet finisher, wherein said stapler angularly pivots about the axis of said guide shaft by means of said cam as said stapler moves along said guide shaft.

20. An image forming system comprising:

an image forming apparatus configured to form a toner image on a recording medium in accordance with input image data; and a sheet finisher for executing preselected processing with the sheet introduced into said sheet finisher from said image forming apparatus and then discharging said sheet, said sheet finisher comprising:

a sheet stacking device configured to receive sheets sequentially delivered thereto;

a jogging device configured to jog the sheets received within said sheet stacking device;

a stapler configured to staple a sheet stack jogged in said sheet stacking device;

a guide shaft supporting said stapler such that said stapler is movable along said guide shaft in a direction perpendicular to a direction of sheet conveyance and angularly pivots about a single axis, said single axis being an axis of said guide shaft; and a moving device configured to move said stapler along said guide shaft in the direction perpendicular to the direction of sheet conveyance, said moving device includes a cam configured to controllably regulate movement of said stapler, said cam being fixedly mounted on a body of said sheet finisher, wherein said stapler angularly pivots about the axis of said guide shaft by means of said cam as said stapler moves along said guide shaft.

* * * * *